US007207782B2

(12) United States Patent
Heaps et al.

(10) Patent No.: US 7,207,782 B2
(45) Date of Patent: Apr. 24, 2007

(54) VACUUM PUMP

(75) Inventors: David Heaps, Leeds (GB); Andrew G. L. Blackwood, Leeds (GB)

(73) Assignee: Wabco Automotive UK Limited (GB)

( * ) Notice: Subject to any disclaimer, the term of this patent is extended or adjusted under 35 U.S.C. 154(b) by 0 days.

(21) Appl. No.: 10/499,369

(22) PCT Filed: Dec. 17, 2002

(86) PCT No.: PCT/GB02/05717

§ 371 (c)(1),
(2), (4) Date: Apr. 6, 2005

(87) PCT Pub. No.: WO03/056184

PCT Pub. Date: Jul. 10, 2003

(65) Prior Publication Data

US 2005/0180865 A1 Aug. 18, 2005

(30) Foreign Application Priority Data

Dec. 21, 2001 (GB) ..... 0130717.2

(51) Int. Cl.
*F04B 49/00* (2006.01)

(52) U.S. Cl. ..... 417/220; 417/310

(58) Field of Classification Search ..... 418/15, 418/255; 417/204, 220, 310
See application file for complete search history.

(56) References Cited

U.S. PATENT DOCUMENTS 2,639,855 A 5/1953 Daniels
4,021,162 A * 5/1977 Shinoda ..... 418/82
4,183,723 A * 1/1980 Hansen et al. ..... 417/204
4,295,804 A 10/1981 Pezzot
4,544,337 A 10/1985 Maruyama
4,554,055 A * 11/1985 Rooney ..... 203/89
4,697,994 A * 10/1987 Ishizawa et al. ..... 418/8

FOREIGN PATENT DOCUMENTS

| | | |
|---|---|---|
| DE | 1-551-135 | 4/1972 |
| DE | 37-18576 A1 | 12/1988 |
| EP | 0-264-778 | 4/1988 |
| EP | 0-436-330 | 7/1991 |
| EP | 0-436-331 A1 | 7/1991 |
| JP | 1-224490 | 9/1989 |
| JP | 2-191896 | 7/1990 |
| JP | 3-61691 | 3/1991 |
| JP | 3-185290 | 8/1991 |

OTHER PUBLICATIONS

International Search Report Dated Mar. 25, 2003.

* cited by examiner

*Primary Examiner*—Ehud Gartenberg
*Assistant Examiner*—Ryan Gillan
(74) *Attorney, Agent, or Firm*—Nixon Peabody LLP; Jeffrey L. Costellia

(57) ABSTRACT

A rotating vane vacuum pump has a secondary inlet (4) which permits additional suction after the primary inlet (3) has closed.

15 Claims, 2 Drawing Sheets

VACUUM PUMP

The present invention relates to a vacuum pump and in particular, though not exclusively, to a vacuum pump for use in conjunction with an automotive braking system.

Sliding vane vacuum pumps are known to suffer from reduced efficiency when operating at low speed, because of internal leakage within the pump. At high operating speeds the time interval between opening and closing of the pump inlet is reduced, and leakage can be contained within acceptable limited. Leakage at relatively low speeds can be reduced by the use of special materials for the vane tips, and reduced clearance between the vane tips and the pump casing. However such measures tend to increase the cost of the pump significantly. What is required is a pump which can operate more efficiently at low speeds.

According to the present invention there is provided a vacuum pump comprising a casing defining a chamber, the chamber having a first inlet, an outlet, a rotor rotatable in the chamber and a vane slidably supported by said rotor, the vane being rotatable so as to draw fluid from the first inlet into the chamber and subsequently expel said fluid through the outlet, wherein the chamber is provided with a second inlet adapted to permit fluid to be drawn into the chamber after closure of the first inlet and to be exhausted through the outlet.

Thus at no time are both inlets connected to the pump chamber at the same time.

The second inlet permits some work to be performed by the pump during a greater portion of the rotary cycle. It will be appreciated that both the inlets are fed from a common chamber and exhaust through a common outlet of the pump. The pump may be provided with more than one vane.

The inlets are positioned such that fluid, typically air, is drawn sequentially therethrough into the chamber as the vane is rotated. The inlets inlet are preferably provided with non return means so as to prevent air being returned to the reservoir as it is expelled through the outlet. The inlets may be connected to a common reservoir. Alternatively the first and second inlets may be connected to different reservoirs.

The inlets may be connected to the reservoir by a common feed line. In such an embodiment there may be provided a single feed line extending from the reservoir to the first inlet, the casing being drilled so as to allow fluid communication from said feed line to the second inlet. Alternatively the inlets may have separate connections to the reservoir.

The vane of the pump may be provided with tips which are caused by centripetal forces to contact the pump chamber. In such an embodiment each tip may comprise an insert retained to the vane. The insert may be provided with a projection which is received with a sliding fit in a corresponding recess of the vane. The projections and recesses of the vane and tip may be reversed.

A vacuum pump in accordance with the invention will now be described by way of example with reference to the accompanying drawings in which.

Figure 1:
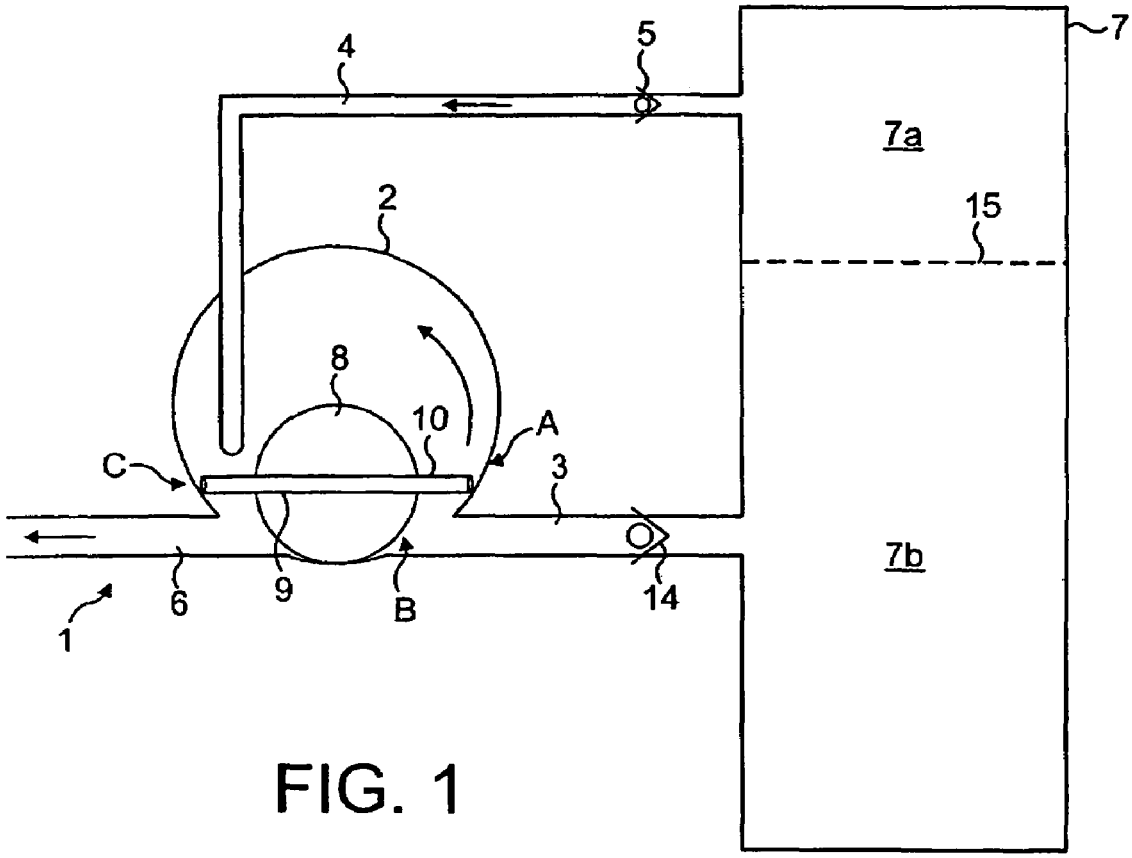
FIG. 1 is a diagrammatic cross section of a vacuum pump according to the present invention.

Referring firstly to FIG. 1, there is shown a vacuum pump, generally designated 1, having a chamber 2 of constant depth and having a generated shape accordingly to the circular motion of a vane 10, to be described. The body has a main inlet 3 provided with a non-return valve 14, a secondary inlet 4 provided with a non return valve 5, and an outlet 6. The inlets 3,4 may be connected to separate consumers, such as separate reservoirs 7*a,* 7*b,* or a common reservoir 7. Broken line 15 is employed for the sake of simplicity to represent the common 7 or separate 7*a,*7*b* reservoirs. The pump 1 is operable to partially evacuate the or each reservoir 7,7*a,*7*b.* The outlet 6 is vented in any suitable manner, for example to atmosphere, or in the case of an I.C. engine to the crank case.

Within the pump body there is provided an off-centre rotatable hub 8 having a slot 9 within which a blade or vane 10 is free to slide. The respective ends of the vane 10 make contact with the internal surface of the chamber 2 to provide a seal therebetween as the vane 10 is rotated by the hub 8. The internal shape of the chamber 2 corresponds to the desired motion of the vane 10, and is arranged to be in close contact with the tips of the vane 10 at all times. The tips of the vane 10 may float in order to provide improved sealing due to centripetal forces as will be described in greater detail below.

As the vane 10 is rotated in an anticlockwise direction indicated in FIG. 1 it sweeps across the position where the main inlet 3 connects to the chamber 2. This position is indicated as position A in the figure. As the vane 10 moves anticlockwise, area B, which can be considered to be behind the vane 10 in the direction of rotation, expands. The increase in size of area B lowers the pressure within the chamber 2 thus causing air to flow from the reservoir 7 or first reservoir 7*b* through the main inlet and into the chamber 2. Continued rotation of the vane 10 draws further air into the chamber 2.

Eventually the vane 10 is rotated to a position where the opposite end portion thereof, sweeps across the main inlet 3/chamber connection thereby isolating the hitherto expanding area B from the main inlet 3. The pressure within the now isolated area B is still less than that of the reservoir 7. Continued rotation of the vane 10 causes it to sweep across the position where the secondary inlet 4 connects to the chamber 2 thus re-establishing fluid communication between the reservoir 7 and the chamber 2 or, alternatively, establishing fluid communication between the second reservoir 7*a* and the chamber 2. Due to the fact that, as noted above, the pressure within the pump body 2 is less than the reservoir 7,7*a,* additional air is drawn from the reservoir 7,7*a* through the secondary inlet 4 and into the chamber 2.

As the vane 10 continues to rotate it sweeps across the position where the outlet 6 meets the chamber 2. Thereafter area B starts to reduce and thereby pushing the air drawn into the chamber 2 from the reservoir 7 or reservoirs 7*a,*7*b* to atmosphere. The non return valves 5, 14 prevent the air from flowing back to the reservoir 7 or reservoirs 7*a,*7*b* via the inlets 3,4.

Figure 2:
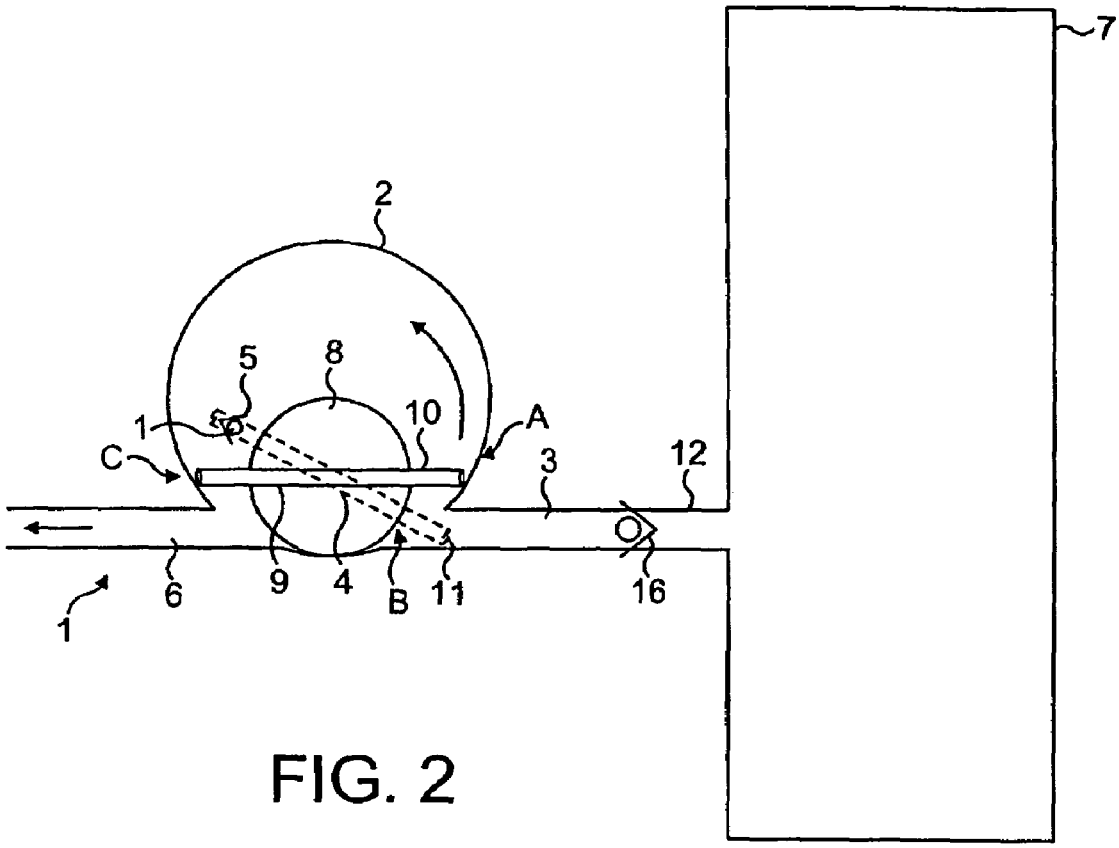
FIG. 2 is a diagrammatic cross section of an alternative embodiment of a vacuum pump according to the present invention.

Referring now to FIG. 2 there is shown a further embodiment of the present invention. Features common to the embodiment described with reference to FIG. 1 are identified with like reference numerals. The pump 1 of FIG. 2 differs from that of FIG. 1 in that the pump inlets 3,4 are connected to the reservoir by a common feed line 12. In this embodiment the secondary inlet 4 is connected to the feed line 1-2 via an internal cross drilling 11 of the pump casing. In an alternative embodiment (not shown) the secondary inlet may comprise a separate conduit extending between the feed line and a secondary inlet port on the pump. As before both inlets 3,4 are provided with non return valves 16, 17 to prevent air drawn into the chamber from being returned to the reservoir 7.

Figure 3:
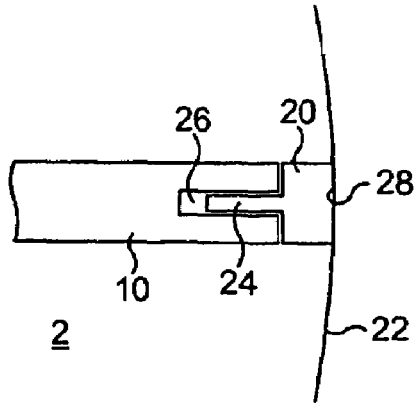
FIG. 3 is a diagrammatic representation of a vane end and tip.

Referring now to FIG. 3 there is shown an embodiment of a vane tip 20. The tip 20 is mounted to an end of a vane 10. In use, the tip 20 runs along the curved wall 22 of a pump chamber 2 to provide a seal and to prevent fluid, typically air, from leaking across the end of the vane 10. The tip 20 is provided with a projection 24 which is received with a sliding fit in a correspondingly shaped recess 26 of the vane 10. The tip 20 is provided with a curved end 28 shaped to fit in a required manner to the wall 22. In use, the sliding nature of the fit between the tip 20 and the vane 10 ensures that the tip 20 is urged into contact with the wall 22 by the centripetal forces resulting from rotation of the vane 10.

The present invention increases the efficiency of the pump, especially when operating at elevated rotational speeds, by maximising the amount of air drawn from the reservoir per rotation of the hub and vane.

The invention claimed is:

1. A vacuum pump comprising a casing defining a chamber, the chamber having a first inlet, an outlet, a rotor rotatable in the chamber and a single vane that is slidably supported by a slot extending fully across said rotor, the vane being rotatable so as to draw fluid from the first inlet into the chamber and subsequently expel said fluid through the outlet, wherein the chamber is provided with a second inlet adapted to permit fluid to be drawn into the chamber after closure of the first inlet by rotation of the vane, and before expelling said fluid in the chamber through the outlet.

2. A vacuum pump as claimed in claim 1 wherein the first and second inlets are provided with non return means to prevent outflow of fluid therethrough.

3. A vacuum pump comprising a casing defining a chamber, the chamber having a first inlet, an outlet, a rotor rotatable in the chamber and a vane slidably supported by said rotor, the vane being rotatable so as to draw fluid from the first inlet into the chamber and subsequently expel said fluid through the outlet, wherein the chamber is provided with a second inlet adapted to permit fluid to be drawn into the chamber after closure of the first inlet and to be exhausted through the outlet, wherein the inlets are branched from a common feed line.

4. A vacuum pump as claimed in claim 3 and having an internal duct connecting said first and second inlets.

5. A vacuum pump as claimed in claim 1 or claim 2, wherein the first and second inlets are separate.

6. A vacuum pump as claimed in claim 1, wherein said vane is provided with a separate vane tips, said vane tips being adapted to be urged into contact with the wall of said chamber by rotation of the vane.

7. A vacuum pump as claimed in claim 6, wherein said vane tips are provided with a projection which is received with a sliding fit in a correspondingly shaped recess of the vane, so as to permit relative radial movement thereof.

8. A vacuum pump as claimed in claim 1, wherein said vane is provided with a projection which is received with a sliding fit in a correspondingly shaped recess of the vane tip, so as to permit relative radial movement thereof.

9. A vacuum pump as claimed in claim 3, wherein said vane is provided with a separate vane tips, said vane tips being adapted to be urged into contact with the wall of said chamber by rotation of the vane.

10. A vacuum pump as claimed in claim 9, wherein said vane tips are provided with a projection which is received with a sliding fit in a correspondingly shaped recess of the vane, so as to permit relative radial movement thereof.

11. A vacuum pump as claimed in claim 3, wherein said vane is provided with a projection which is received with a sliding fit in a correspondingly shaped recess of the vane tip, so as to permit relative radial movement thereof.

12. A vacuum pump as claimed in claim 3, and having a plurality of vanes.

13. A vacuum pump as claimed in claim 3, wherein the first and second inlets are provided with non return means to prevent outflow of fluid therethrough.

14. A vacuum pump as claimed in claim 3, wherein the first and second inlets are separate.

15. A vacuum pump as claimed in claim 1, and having an internal duct connecting said first and second inlets.

* * * * *